US009145734B2

(12) United States Patent
Hart

(10) Patent No.: US 9,145,734 B2
(45) Date of Patent: Sep. 29, 2015

(54) CASING MANIPULATION ASSEMBLY WITH HYDRAULIC TORQUE LOCKING MECHANISM

(71) Applicant: Baker Hughes Incorporated, Houston, TX (US)

(72) Inventor: Daniel R. Hart, Sugar Land, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 390 days.

(21) Appl. No.: 13/689,911

(22) Filed: Nov. 30, 2012

(65) Prior Publication Data

US 2014/0151067 A1 Jun. 5, 2014

(51) Int. Cl.

| | |
|---|---|
| ***E21B 3/035*** | (2006.01) |
| ***E21B 43/10*** | (2006.01) |
| ***E21B 7/20*** | (2006.01) |
| ***E21B 19/07*** | (2006.01) |

(52) U.S. Cl.
CPC . *E21B 3/035* (2013.01); *E21B 7/20* (2013.01); *E21B 19/07* (2013.01); *E21B 43/10* (2013.01)

(58) Field of Classification Search
CPC ..... E21B 3/035; E21B 7/20; E21B 19/24; E21B 19/166; E21B 33/0422
See application file for complete search history.

(56) References Cited

U.S. PATENT DOCUMENTS

| | | | | |
|---|---|---|---|---|
| 1,825,026 | A * | 9/1931 | Thomas | 294/86.19 |
| 3,321,018 | A * | 5/1967 | McGill | 166/135 |
| 6,309,002 | B1 | 10/2001 | Bouligny | 294/86.25 |
| 6,311,792 | B1 | 11/2001 | Scott et al. | 175/162 |
| 6,550,540 | B2 | 4/2003 | Trent | 166/382 |
| 6,705,413 | B1 | 3/2004 | Tessari | 175/27 |
| 7,021,374 | B2 | 4/2006 | Pietras | 166/77.51 |
| 7,044,241 | B2 | 5/2006 | Angman | 175/61 |
| 7,077,205 | B2 | 7/2006 | Eddison | 166/301 |
| 7,121,350 | B2 | 10/2006 | Aldridge et al. | 166/382 |
| 7,140,445 | B2 | 11/2006 | Shahin et al. | 166/380 |
| 7,219,744 | B2 | 5/2007 | Pietras | 166/379 |
| 7,225,880 | B2 | 6/2007 | Braddick | |
| 7,325,610 | B2 | 2/2008 | Giroux et al. | 166/291 |
| 7,475,742 | B2 | 1/2009 | Angman et al. | 175/61 |
| 7,513,300 | B2 | 4/2009 | Pietras et al. | 166/77.51 |
| 7,624,820 | B2 | 12/2009 | Angman et al. | 175/171 |
| 7,647,990 | B2 | 1/2010 | Tessari et al. | 175/171 |
| 7,654,325 | B2 | 2/2010 | Giroux et al. | 166/291 |
| 7,694,730 | B2 | 4/2010 | Angman | 166/77.51 |
| 7,757,754 | B2 | 7/2010 | McKay | 166/55.7 |
| 8,002,032 | B2 | 8/2011 | Cenac et al. | |
| 2001/0042625 | A1* | 11/2001 | Appleton | 166/379 |
| 2005/0199426 | A1* | 9/2005 | Smith et al. | 175/57 |
| 2007/0256865 | A1 | 11/2007 | Cruickshank | |
| 2008/0210439 | A1 | 9/2008 | Angman et al. | 166/382 |
| 2009/0242213 | A1 | 10/2009 | Braddick | |
| 2011/0042105 | A1* | 2/2011 | Xu | 166/382 |
| 2011/0073372 | A1 | 3/2011 | Prill et al. | |
| 2012/0125632 | A1 | 5/2012 | Blair et al. | 166/380 |
| 2017/0111556 | | 5/2012 | Palmer et al. | 166/77.53 |

* cited by examiner

*Primary Examiner* — David Andrews
*Assistant Examiner* — Tara Schimpf
(74) *Attorney, Agent, or Firm* — Shawn Hunter

(57) ABSTRACT

Devices and method for engaging a casing member for manipulation. A hydraulic torque locking mechanism is incorporated into a casing manipulation assembly. The hydraulic torque locking mechanism includes a clutch mechanism that is actuated using surface pump pressure from tool circulation.

13 Claims, 6 Drawing Sheets

CASING MANIPULATION ASSEMBLY WITH HYDRAULIC TORQUE LOCKING MECHANISM

BACKGROUND OF THE INVENTION

1. Field of the Invention

The invention relates generally to a torque locking mechanism used in conjunction with casing manipulation systems.

2. Description of the Related Art

A number of systems are employed wherein drilling or reaming operations are done using casing strings. In these systems, a drilling tool or reaming tool is mounted upon a casing string in order to drill a wellbore or to enlarge or smooth an existing wellbore. The casing string and mounted drilling/reaming tool is rotated by a rig top drive unit at the surface.

At times, these drilling or reaming tools can become stuck or require repositioning or manipulation from surface. In order to do this, a casing manipulation tool must be interconnected between the top drive unit and the casing string when the casing string needs manipulation. The casing manipulation tool allows the casing to be secured such that it can be pulled on, set down on and rotated. Casing manipulation tools are described in U.S. Pat. Publ. No. US 201210111556 by Palmer et al. and U.S. Pat. Publ. 2012/0125632 by Blair et al. Both of these references are owned by the assignee of the present application and are herein incorporated by reference in their entirety. Typically, right-hand rotation provided by the top drive is used to set the slips of the casing manipulation tool to cause it to grip the casing string.

SUMMARY OF THE INVENTION

The invention provides systems and methods for preventing inadvertent unsetting of a casing manipulation tool by left-hand rotation of a casing string or casing member. In a described embodiment, a casing manipulation assembly includes a central mandrel that is rotated by a top drive unit and a housing that radially surrounds the mandrel. When the mandrel is rotated by the top drive, the housing is moved axially with respect to the mandrel in order to set slips within the casing string or member.

In a described embodiment, a hydraulic torque locking mechanism is incorporated into a casing manipulation assembly. The hydraulic torque locking mechanism includes a clutch mechanism that is actuated using surface pump pressure from tool circulation. The fluid pressure acts upon a piston that is moveable to selectively engage the clutch mechanism. Thus, the torque locking mechanism is moveable between an unengaged position and an engaged position. The torque locking mechanism selectively locks rotation of the housing with respect to the mandrel.

In operation, the torque locking mechanism and casing manipulation tool are operably interconnected with a top drive device. The casing manipulation assembly is then run into the casing string and the torque locking mechanism shoulders on top of the casing string. The torque locking mechanism is run-in in the unengaged position. Thereafter, after applying set down weight of the torque locking mechanism to provide friction resistance, the top drive device provides right-hand rotation to cause the casing manipulation tool to become set within and grip the casing member. Next, the torque locking mechanism is moved from the unengaged position to the engaged position by pump pressure. When the torque locking mechanism is engaged, right-hand torque is now transmitted from the top drive to the casing string. Any left-hand rotation to the casing is prevented by the engagement of clutch teeth in the torque locking mechanism.

BRIEF DESCRIPTION OF THE DRAWINGS

For a thorough understanding of the present invention, reference is made to the following detailed description of the preferred embodiments taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
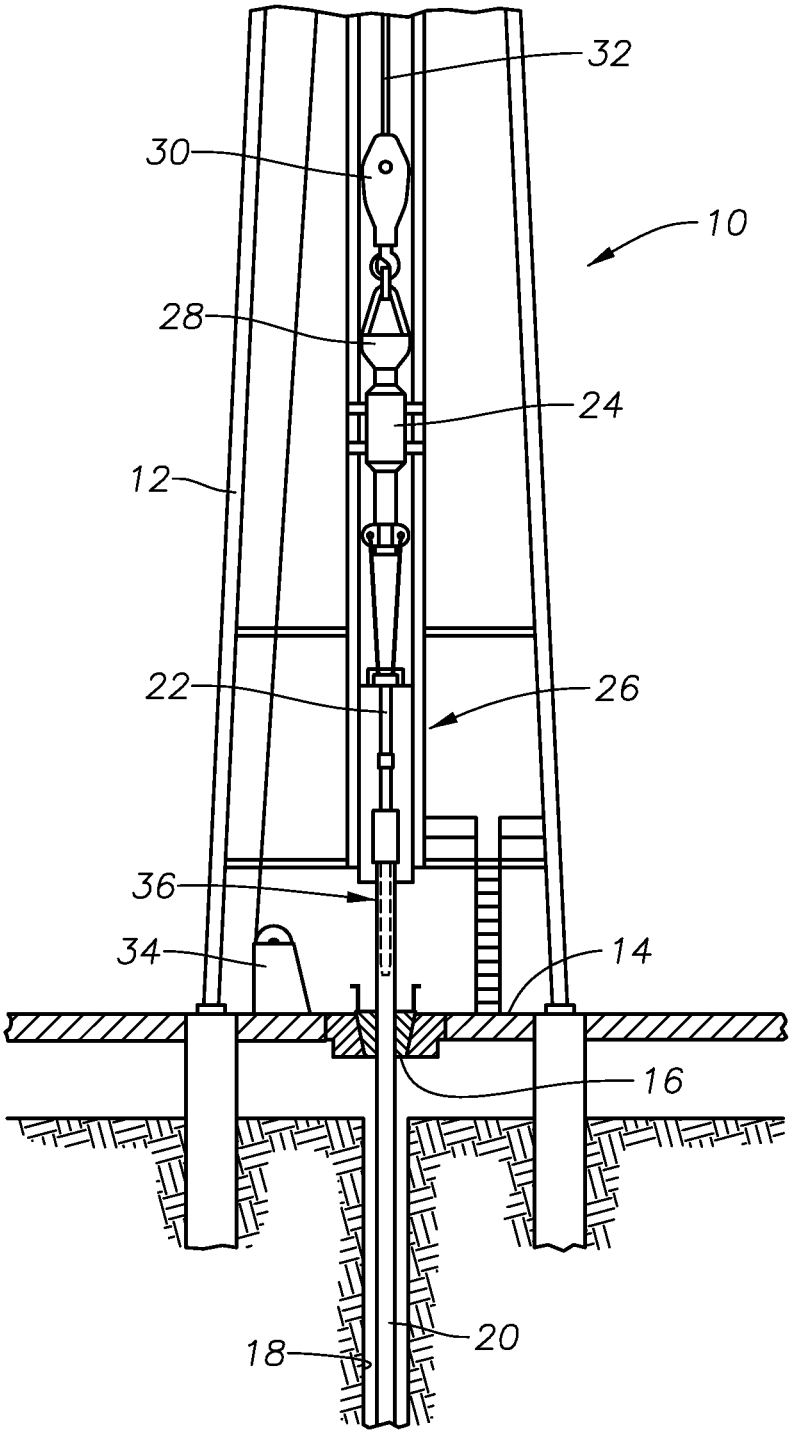
FIG. 1 is a side, cross-sectional view of an exemplary wellbore containing a casing manipulation tool in accordance with the present invention.

FIG. 1 depicts a rig 10 having a derrick 12 with a rig floor 14 at its lower end and having an opening 16 through which a wellbore 18 can be accessed. The wellbore 18 is shown to contain a portion of casing 20. A work string 22 is shown suspended from a rotary top drive drilling unit 24 of a type known in the art which is used to rotate the work string 22. A pipe handler assembly 26 is also suspended from the drilling unit 24 and is operable to suspend the work string 22. Fluid can be introduced into the upper end of the work string 22 through a swivel 28 connected to the upper end of the top drive unit 24. The swivel 28 and connected top drive unit 24 and pipe handler 26 are, in turn, suspended from a traveling block 30 which is suspended and moved upwardly and downwardly by a line 32 which is connected at its upper end to a crown block (not shown) and actuated by draw works 34.

Figure 2:
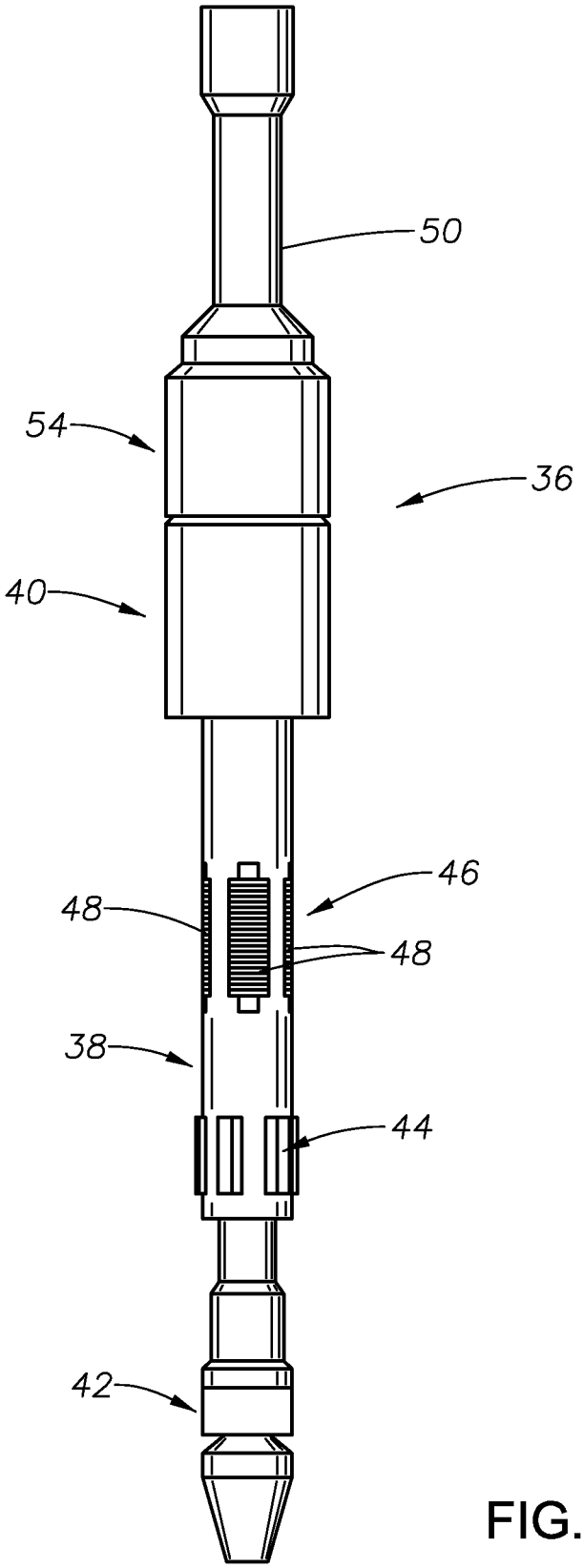
FIG. 2 is an external, isometric view of an exemplary torque locking mechanism constructed in accordance with the present invention in the run-in position.

Affixed to the lower end of the work string 22 is a casing manipulation assembly, generally indicated at 36. The casing manipulation assembly 36 is shown in greater detail in FIG. 2 and includes a casing manipulation tool 38 and a hydraulic torque locking mechanism 40. The casing manipulation tool 38 features a packoff mandrel assembly 42 and a friction block assembly wherein friction blocks 44 as biased radially outwardly by springs 45 (see FIG. 6). In addition, the casing manipulation tool 38 includes a slip assembly 46 which includes anchoring slips 48 that are moved radially outwardly to grip the interior of the casing 20. Further details relating to the construction and operation of casing manipulation tools are found in U.S. Pat. Publ. No. US 2012/0111556 by Palmer et al. and U.S. Pat. Publ. 2012/0125632 by Blair et al. However, in general operation, the casing manipulation tool 38 is disposed into the casing 20 and then the top drive unit 24 will apply right-hand rotation to the casing manipulation tool 38 to cause the slips 48 to move radially outwardly into anchoring contact with the casing 20.

Figure 3:
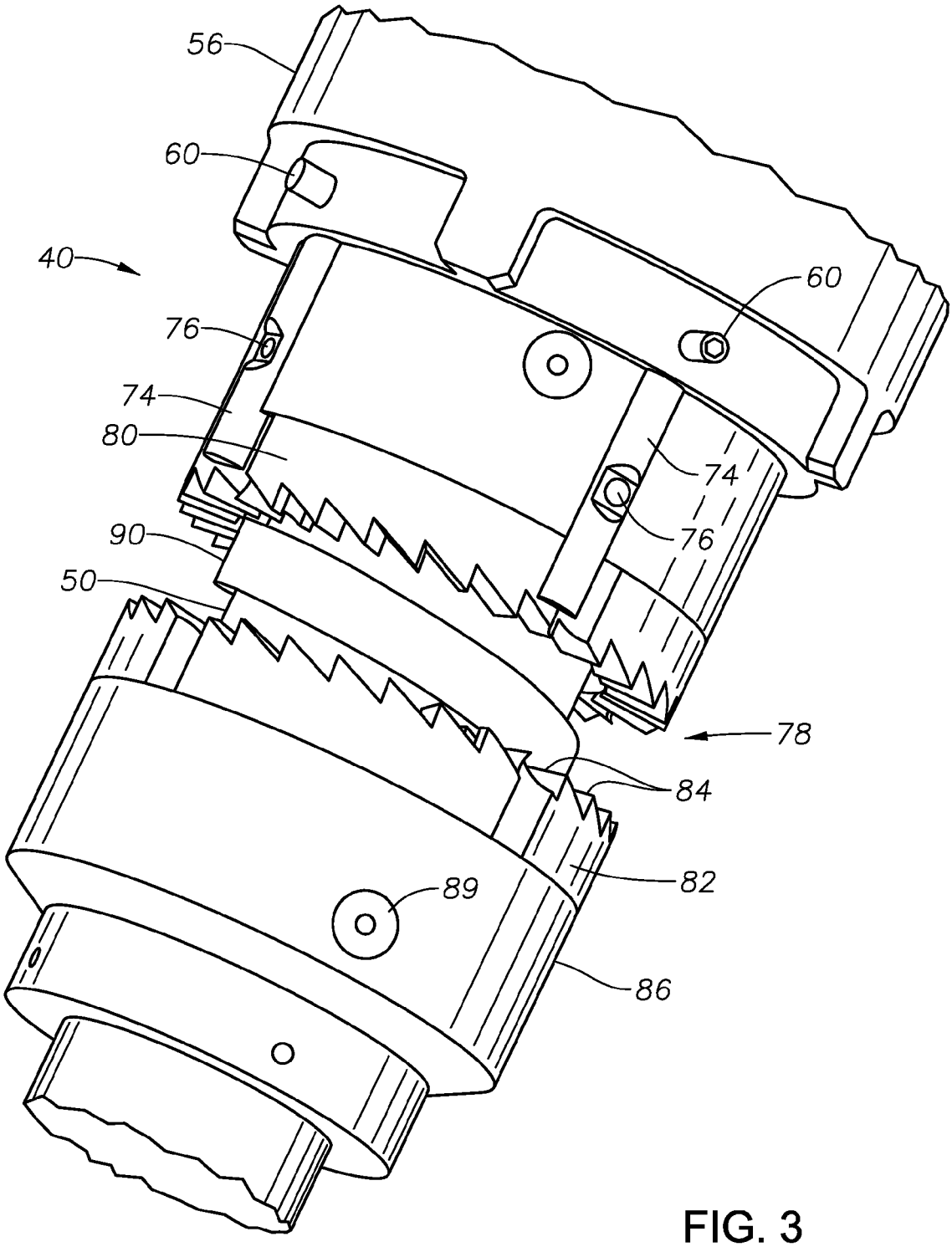
FIG. 3 is an enlarged external, isometric view of interior portions of the torque locking mechanism shown in FIG. 2.
Figure 4:
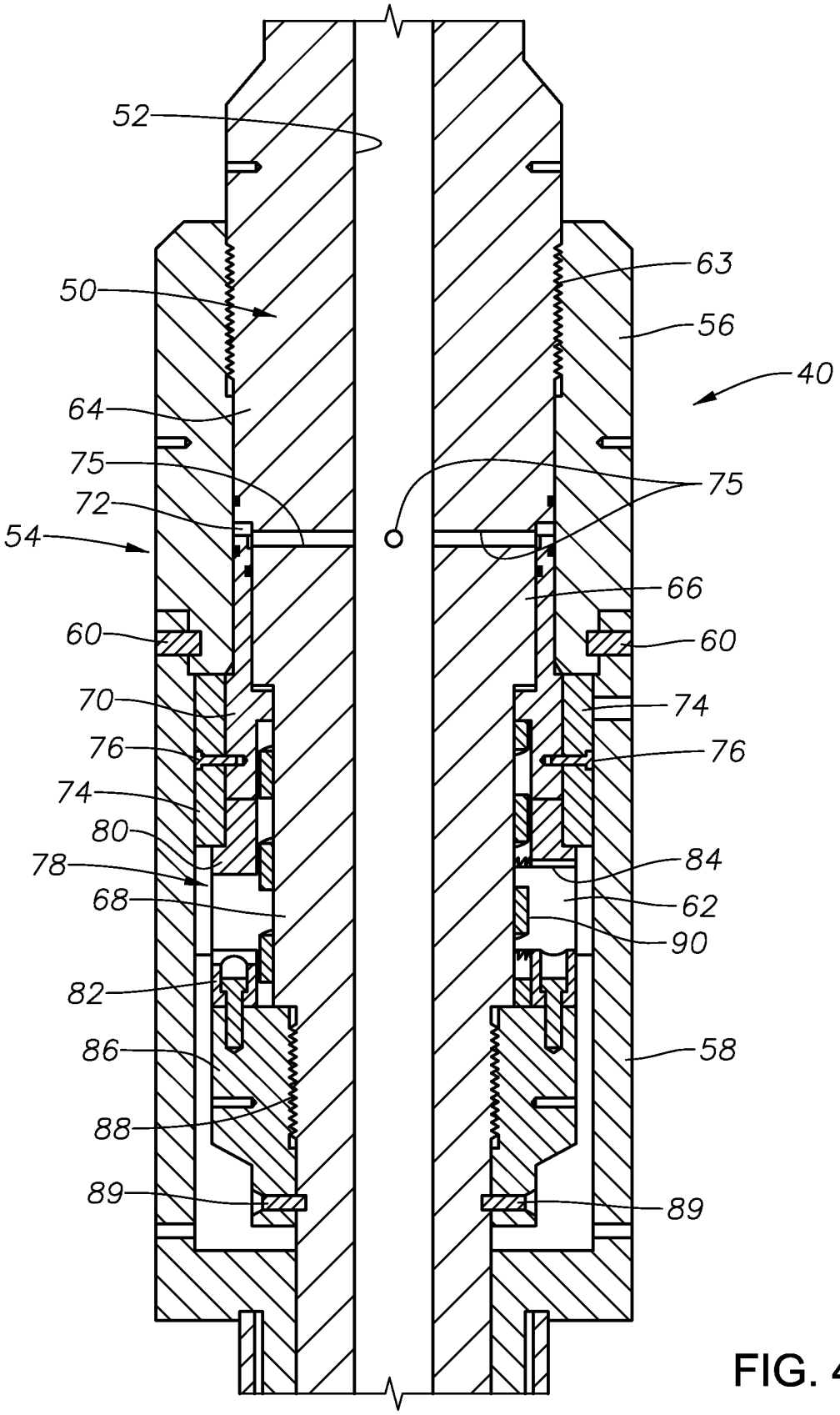
FIG. 4 is a side, cross-sectional view of the torque locking mechanism shown in FIG. 2 with the mechanism also in a run-in position.
Figure 5:
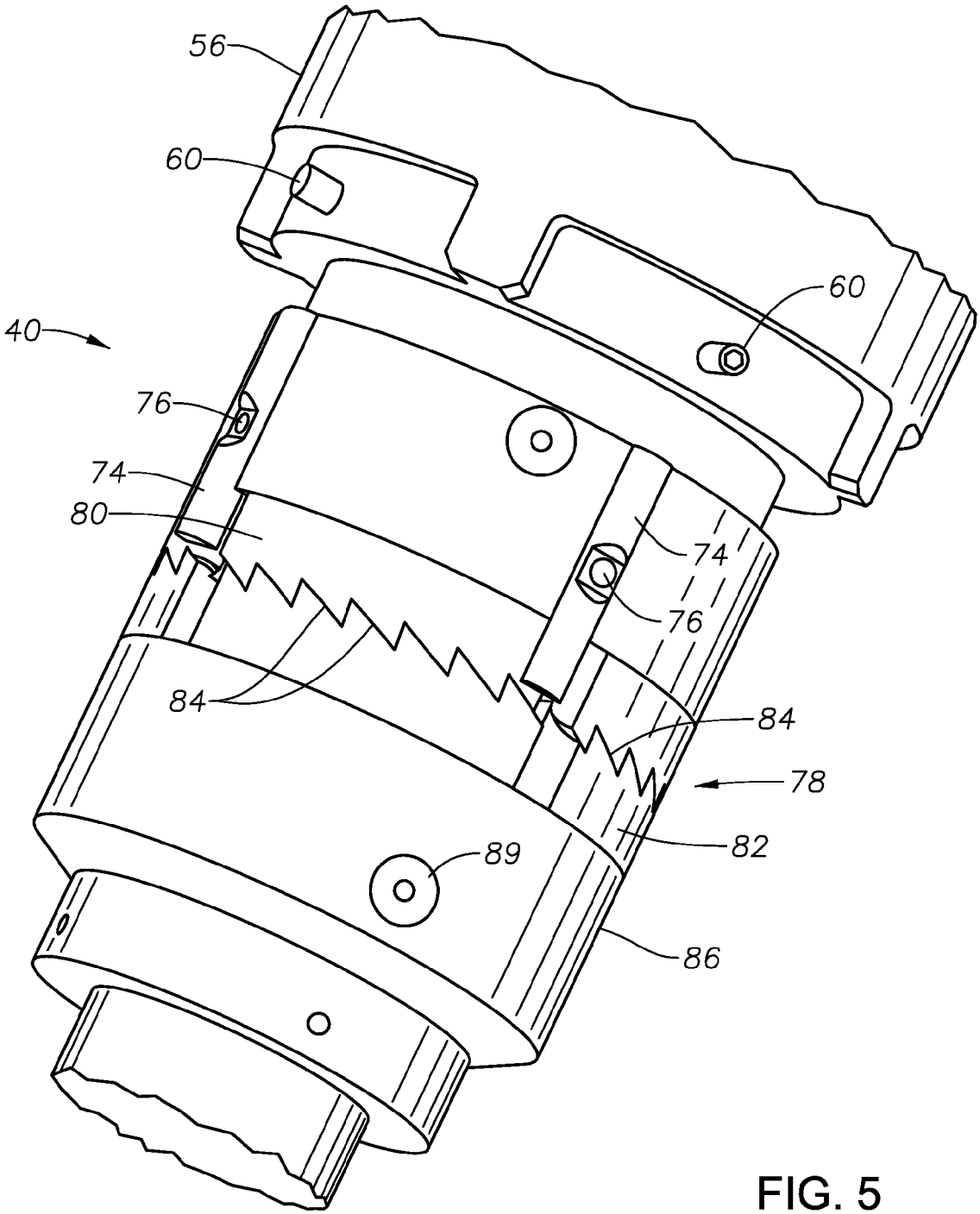
FIG. 5 is an external, isometric view of the torque locking mechanism shown in FIGS. 3-4, now in an engaged position.

FIGS. 2-6 depict the exemplary hydraulic torque locking mechanism 40 constructed in accordance with the present invention. The torque locking mechanism 40 includes a central mandrel 50 having a central axial flowbore 52 defined along its length. A housing 54 circumferentially surrounds the central mandrel 50. In the depicted embodiment, the housing 54 is made up of upper and lower housing portions 56, 58 that are secured together by connectors 60. In FIGS. 3 and 5, the lower housing portion 58 has been removed to allow interior components to be seen. As shown in FIG. 4, clutch chamber 62 is defined within the lower housing portion 58. A threaded interface 63 is formed between the housing 54 and the mandrel 50. In a particular embodiment, the threaded interface 63 has left-handed threading, and right-hand rotation applied by the top drive unit 24 (FIG. 1) will move the mandrel 50 axially with respect to the housing 54, setting the slips 48.

The upper axial end of the central mandrel 50 may be provided with threaded portions, as are known in the art, to allow it to be affixed to a neighboring component. Within the housing 54, the central mandrel 50 is made up of an enlarged diameter portion 64, an intermediate diameter portion 66 and a reduced diameter portion 68.

An annular piston 70 (FIG. 4) circumferentially surrounds the intermediate diameter and reduced diameter portions 66, 68 of the central mandrel 50. An annular fluid chamber 72 is defined within the housing 54 above the piston 70. Lateral fluid passages 75 extend from the central axial flowbore 52 to the annular piston chamber 72. The piston 70 is slidably moveable upon the central mandrel 50. Anti-rotation guide pins 74 are affixed to the piston 70 by screws 76.

A clutch assembly, generally shown at 78 is contained within the clutch chamber 62. The clutch assembly 78 includes first and second complementary annular clutch pads 80, 82. The clutch pads 80, 82 each present complementary teeth 84. The first clutch pad 80 is affixed to the piston 70. The second clutch pad 82 is affixed to a clutch ring 86. The clutch ring 86 is secured to the mandrel 50 by threaded connection 88. Anti-rotation pins 89 are used to prevent the threaded connection 88 from unthreading. The teeth 84 of the clutch pad 80 and those of the clutch pad 82 will interlock with each other, as depicted in FIG. 5, when the clutch pads 80, 82 are brought into contact with each other. The clutch assembly 78 can be moved between art unengaged position, depicted in FIGS. 3-4, and an engaged position, which is depicted in FIG. 5.

A compression spring 90 is disposed between the piston 70 and the clutch ring 86 and biases the clutch assembly 78 toward the unengaged position. The guide pins 74 are disposed within guide pin recesses 92 that are formed within the surrounding housing 54. The guide pins 74 can move axially within the recesses 92. However, location of the pins 74 prevents the affixed piston 70 from rotation with respect to the housing 54.

The hydraulic torque locking mechanism 40 is moved from the unengaged position to the engaged position by flowing hydraulic fluid into the work string 22 and into the flowbore 52 of the mechanism 40. Fluid will enter the annular piston chamber 72 via the lateral passages 75. Fluid will urge the piston 70 axially downwardly to cause the clutch pads 80, 82 to be brought into engagement with each other. Spring 90 is compressed when this occurs. When fluid flow stops, the spring 90 urges the torque locking mechanism back to the unengaged position.

Figure 6:
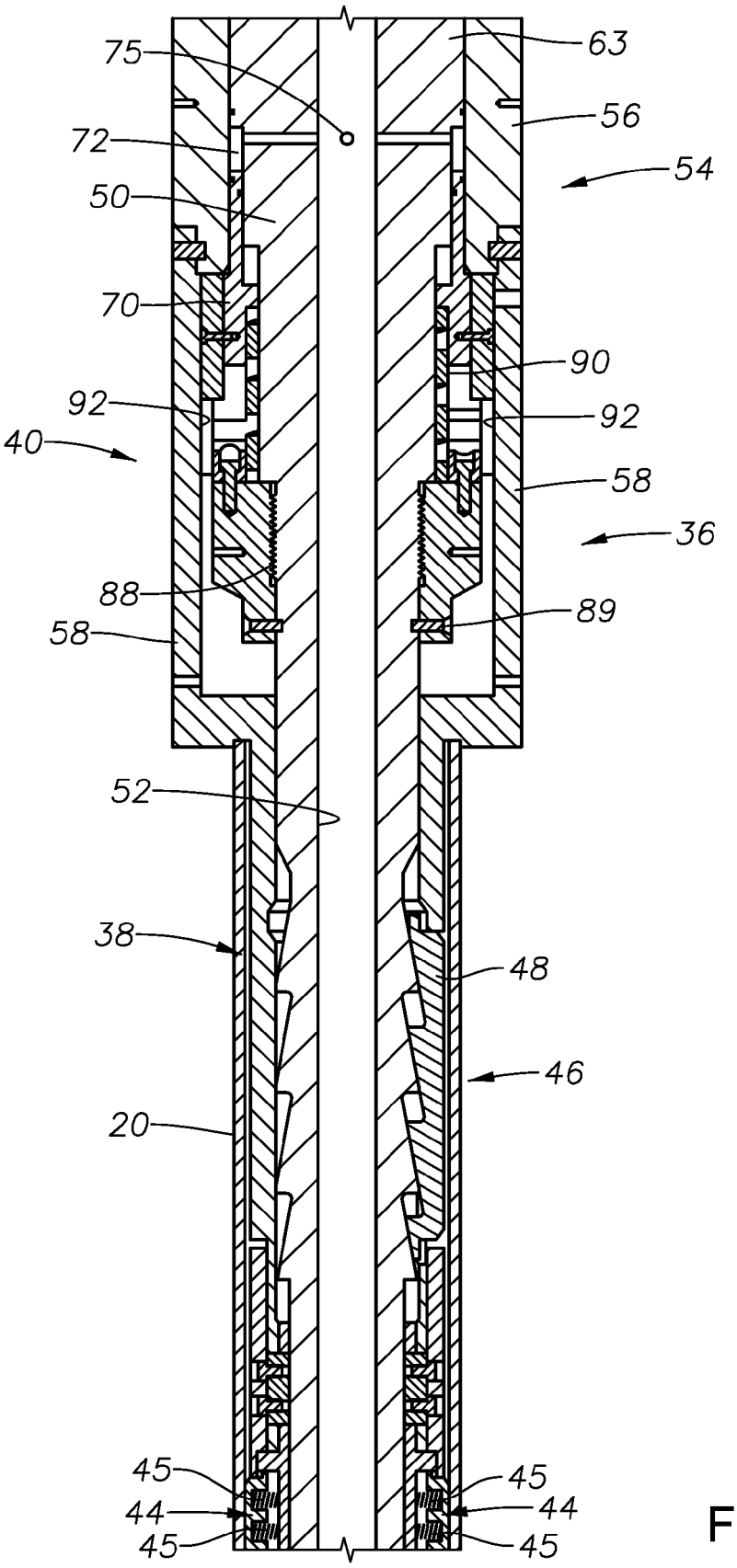
FIG. 6 is a side, cross-sectional view of an exemplary casing manipulation assembly, now engaged with a casing member.

In operation, the casing manipulation assembly 36 is used to secure the casing 20 and then allow rotation or axial movement to be applied to the casing 20. The casing 20 is secured by at least partially inserting the casing manipulation tool 38 into the casing 20 and then securing it to the casing 20 by setting the slips 48. As the casing manipulation tool 38 is inserted into the casing 20, the friction blocks 44 create a friction mechanism that will grippingly engage the casing 20 (see FIG. 6) as the blocks 44 are biased radially outwardly by the springs 45. In addition, as depicted in FIG. 6, the lower housing portion 58 is placed in contact with the casing 20. The slips 48 are then set as the work string 22 is rotated by the top drive unit 24. The applied rotation is in the right-hand direction, and this rotation, via the threaded interface 63, will move mandrel 50 upwardly, thereby setting the slips 48. Once the slips 48 are set, the torque locking mechanism 40 is moved from the unengaged position to the engaged position in the manner described above. When engaged, the torque locking mechanism 40 ensures that torque is transmitted from the work string 22 to the casing 20. When engaged, it also ensures that left-hand torque or backlash is not transmitted from the casing string 20 to the casing manipulation tool 38. Such left-hand torque might occur as a result of counter-rotation of the casing. This could be caused by increased torque at a specified speed causing the revolutions to slow down, therefore storing energy into the casing string 20. When the cause of the increase in torque suddenly diminishes, the stored energy in the casing string 20 will "outrun" the desired rotation speed. At that point, the energy that was stored produces a pulse that travels up the casing string 20 in a backwards or left-hand rotation. Engagement of the clutch assembly 78 also prevents the slips 48 from becoming inadvertently unset from the casing 20, which prevents the work string 22 from unattaching from the casing string 20.

It can be seen that the invention provides a casing manipulation assembly 36 that includes a casing manipulation tool 38 that is used to engage a casing member 20 via rotation of a mandrel 50 within the casing manipulation tool 38. The casing manipulation assembly 36 also includes a torque locking mechanism 40 that can be engaged using hydraulic fluid pressure to lock the casing manipulation tool 38 against counter-rotation. In an exemplary method of operation, the casing manipulation tool 38 is first actuated to set the slips 48. Thereafter, the torque locking mechanism 40 is engaged using hydraulic fluid pressure. Once the torque locking mechanism 40 is engaged, the top drive unit 24 can rotate the work string 22 to, in turn, rotate the casing member 20.

Those of skill in the art will recognize that numerous modifications and changes may be made to the exemplary designs and embodiments described herein and that the invention is limited only by the claims that follow and any equivalents thereof.

What is claimed is:

1. A casing manipulation assembly for manipulation of a casing member and comprising:

a central mandrel;

a housing circumferentially surrounding the mandrel and being axially moveable with respect to the mandrel as the mandrel is rotated;

a slip assembly having a slip member that is set within the casing member by axial movement of the mandrel with respect to the housing; and a torque locking mechanism to selectively prevent rotation of the mandrel with respect to the housing, the torque locking mechanism comprising a clutch assembly that is moveable between a first, unengaged position wherein the mandrel can rotate with respect to the housing, and a second, engaged position wherein the mandrel is locked against rotation with respect to the housing, wherein the clutch assembly further comprises a piston circumferentially surrounding the mandrel and moveably disposed within the housing, and first and second clutch pads disposed within the housing that are selectively brought into engaged contact with each other by movement of the piston within the housing.

2. The casing manipulation assembly of claim 1 wherein:

a central axial flowbore is defined within the central mandrel; and the piston is moveable within the housing in response to hydraulic fluid pressure transmitted through the central axial flowbore.

3. The casing manipulation assembly of claim 1, wherein the mandrel further comprises a friction mechanism for engaging the casing member.

4. The casing manipulation assembly of claim 1, wherein the first and second clutch pads have complimentary, interlocking teeth.

5. The casing manipulation assembly of claim 1, wherein the clutch assembly is biased toward the unengaged position by a spring.

6. A torque locking mechanism in a casing manipulation assembly having a mandrel and a housing circumferentially surrounding the mandrel, the torque locking mechanism comprising:

a first clutch pad operably interconnected with the housing;

a second clutch pad operably interconnected with the mandrel;

the first and second clutch pads being moveable between an unengaged position wherein the first and second clutch pads are not in engaged contact with each other to permit rotation of the mandrel with respect to the housing and an engaged position wherein the first and second clutch pads are brought into engaged contact with each other to prevent rotation of the mandrel with respect to the housing; and a piston circumferentially surrounding the mandrel within the housing and wherein the first and second clutch pads are moved to the engaged position as the piston is move axially within the housing.

7. The torque locking mechanism of claim 6, wherein the first and second clutch pads have complementary, interlocking teeth.

8. The torque locking mechanism of claim 6, wherein:

a central axial flowbore is defined within the central mandrel; and the piston is moved within the housing by hydraulic fluid pressure transmitted through the central axial flowbore.

9. The torque locking mechanism of claim 6, wherein the first and second clutch pads are biased toward the unengaged position by a spring.

10. A method of engaging a casing member for manipulation, the method comprising the steps of:

disposing a casing manipulation assembly at least partially within a casing member, the casing manipulation assembly having a mandrel and a housing circumferentially surrounding the mandrel;

rotating the mandrel with respect to the housing to set a locking slip within the casing member;

engaging a torque locking mechanism by interlocking first and second clutch pads to prevent rotation between the housing and the mandrel; wherein the step of interlocking first and second clutch pads further comprises moving a piston within the housing.

11. The method of claim 10 wherein:

a central axial flowbore is defined within the central mandrel; and the piston is moved by hydraulic fluid pressure transmitted through the central axial flowbore.

12. The method of claim 10 further comprising the step of rotating the casing member, with the casing manipulation assembly, after the torque locking mechanism is engaged.

13. The method of claim 10 wherein the step of disposing a casing manipulation assembly at least partially within a casing member further comprises:

shouldering the housing on top of the casing member; and applying set down weight to provide friction resistance between the housing and the casing member.

* * * * *